US006674986B1

(12) United States Patent
Jaskowiak et al.

(10) Patent No.: US 6,674,986 B1
(45) Date of Patent: Jan. 6, 2004

(54) INSULATED JOURNALS FOR A DONOR ROLL

(75) Inventors: Timothy R. Jaskowiak, Webster, NY (US); Joy L. Longhenry, Webster, NY (US); Eugene J. Manno, Ontario, NY (US); Scott Martin, Fairport, NY (US); William R. Klimley, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/271,899

(22) Filed: Oct. 15, 2002

(51) Int. Cl.[7] ..... G03G 15/08
(52) U.S. Cl. ..... 399/265; 399/291

(58) Field of Search ..... 399/265, 266, 399/290, 291

(56) References Cited

U.S. PATENT DOCUMENTS 5,585,909 A 12/1996 Behe et al. ..... 355/285
6,327,453 B1 12/2001 Imaizumi et al. ..... 399/301

*Primary Examiner*—Quana M. Grainger
(74) *Attorney, Agent, or Firm*—Lloyd F. Bean, II

(57) ABSTRACT

A donor structure for developing toner images to an image receiving surface, said structure including a core structure; end caps including journal portions attached to said core structure;a bearing for operatively supporting said donor structure in an imaging device; and electrically isolating coatings carried by said journal portions, said electrically isolating coatings being interposed between said journal portions and said bearings.

12 Claims, 5 Drawing Sheets

INSULATED JOURNALS FOR A DONOR ROLL

BACKGROUND OF THE INVENTION

This invention relates to a donor roll with electrically insulated journals.

Electrostatic reproduction and printing involves uniformly charging a photoconductive member, or photoreceptor, and imagewise discharging it, or imagewise exposing it, based on light reflected from, or otherwise representing, an original image being reproduced or printed. The result is an electrostatically-formed latent image on the photoconductive member. The latent image is developed by bringing a charged developer material into contact with the photoconductive member to form a toner powder image. The toner powder image is transferred to a receiving sheet and then fused by heating.

This process can be modified to form color images. One type of process, called image-on-image processing, superimposes toner powder images of different color toners onto the toner prior to the transfer of the composite toner powder image onto the substrate.

Two-component and single-component developer materials are known. Two-component developer materials comprise magnetic carrier particles and charged toner particles that adhere triboelectrically to the carrier particles and are intended to adhere the photoconductive member.

Single-component developer material typically include only toner particles. The toner particles typically have an electrostatic charge to adhere to the photoconductive member, and magnetic properties to magnetically convey the toner particles from the sump to the developer roll. The toner particles adhere directly to the developer roll. The toner particles are attracted to the donor roll from a magnet or developer roll. From the donor roll, the toner is transferred to the photoconductive member in the development zone.

For both types of developer material, the charged toner particles are brought into contact with the latent image to form a toner image on the photoconductive member. The toner image is transferred to a receiver sheet, which passes through a fuser device where the toner particles are heated and permanently fused to the sheet, forming a hard copy of the original image.

A development device is used to bring the charged toner particles into contact with the latent image formed on the photoreceptor, so that the toner particles adhere electrostatically to the charged areas on the latent image. The development device typically includes a chamber in which the developer material is mixed and charged.

One type of two-component development method and apparatus is known as "scavengeless development". "Hybrid" scavengeless development apparatus typically include a mixing chamber that holds a two-component developer material, at least one developer material developer or magnetic roll, a donor roll, a development zone, and an electrode structure at the development zone between the donor roll and the photoconductive member. The donor roll receives charged toner particles from the developer roll and transports the particles to the development zone. An AC voltage is applied to the electrodes to form a toner cloud in the development zone. Electrostatic fields generated by an adjacent latent image on the photoconductive member surface attract charged toner particles from the toner cloud to develop the latent image on the photoconductive member.

Another variation on scavengeless development uses single-component developer material development systems. As in two-component developer material development systems, the donor roll and electrodes also create a toner cloud.

In both one-component and two-component developer scavengeless development systems, the development apparatus should be able to effectively and controllably transport toner particles into the development zone and donate the charged toner particles to the photoconductive member, to achieve high-quality image development.

In scavengeless development systems, an important factor in achieving effective and controllable transfer of charged toner particles from the donor roll to the photoconductive member is the dimensional control of the components that are involved in the transfer function. The macrouniformity is the result of the accumulated tolerance of these components. Typically, the components include the donor roll, the photoconductive member, such as a photoreceptor belt, and a backerbar that contacts the photoreceptor belt's inner surface opposite to the outer surface to which the toner is transferred.

For proper operation of the donor roll in a hybrid scavengeless development system, the diameter tolerance, runout and surface finish of the donor roll should be as precise as possible. Donor rolls are typically formed by machining a cylindrical body from solid cylindrical stock material, and forming a bore in each of the opposed end faces of the body. Journals are formed from smaller cylindrical stock material and fitted into the bores at both ends of the body. The journals are mounted to bearings to allow for rotation of the roll.

The outer peripheral surface of the body should have a precision size, roundness and runout requirements with respect to the journals. As the roll is rotated about the journals, the outer periphery of the roll may have an eccentric pattern or runout with respect to the journals. The total runout of the donor roll includes the runout between the periphery of the body and counterbore inside diameter, the roundness of the body, and the roundness of the journals.

In addition to the tolerances of the donor roll, the tolerances of the backerbar, photoconductive member and other components involved in the transfer of toner from the donor roll to the photoconductive member contribute to the macrouniformity in the development zone.

If the development zone of the development apparatus changes excessively during imaging due to poor dimensional control of the components, then the ability of the apparatus to effectively and controllably donate charged toner particles to the photoconductive member and achieve high-quality image development can be adversely affected. Particularly, if the total allowable deviations or the development zone nonuniformity of the components involved in the transfer of the charged toner particles from the donor roll to the photoconductive member is too high such that gap non-uniformity occurs then toner may conceivably not deposit uniformly.

The above tolerance requirements are exacerbated in a development system where the donor roll and backerbar need to be spaced closely and electrically isolated from each other. The prior mentioned macrouniformity specification which is a result of the dimensional accuracy of the donor roll and backerbar among others, is gauged when the one bearing on the inboard end and one on the out board end of the donor roll docks onto the top of the radius of the backerbar. The bearings outer diameter is larger than the roll body outer diameter thus when docked, keeping the body a set distance from the backerbar. It is in this gap the photoreceptor is passed. Toner from the donor roll is transferred to the PR belt at the backerbars location. At this point there is a latent image on the belt ready to be developed. As the belt moves by various toners, the toner moves off of the roll to the belt. This requires the toner be of one charge (+) and the image be another (–). Electrically insulating the donor roll bearings from the backerbars prevents electric charges from being transferred from the donor roll, through the backerbars to the photoreceptor belt thus neutralizing the latent image.

There is provided a donor structure for developing toner images to an image receiving surface, said structure comprising: a core structure; end caps including journal portions attached to said core structure; a bearing for operatively supporting said donor structure in an imaging device; and electrically isolating coatings carried by said journal portions, said electrically isolating coatings being interposed between said journal portions and said bearings.

BRIEF DESCRIPTION OF THE DRAWINGS

Various exemplary embodiments of this invention will be described in detail, with reference to the following figures, in which.

DETAILED DESCRIPTION OF EXEMPLARY EMBODIMENTS

Figure 1:
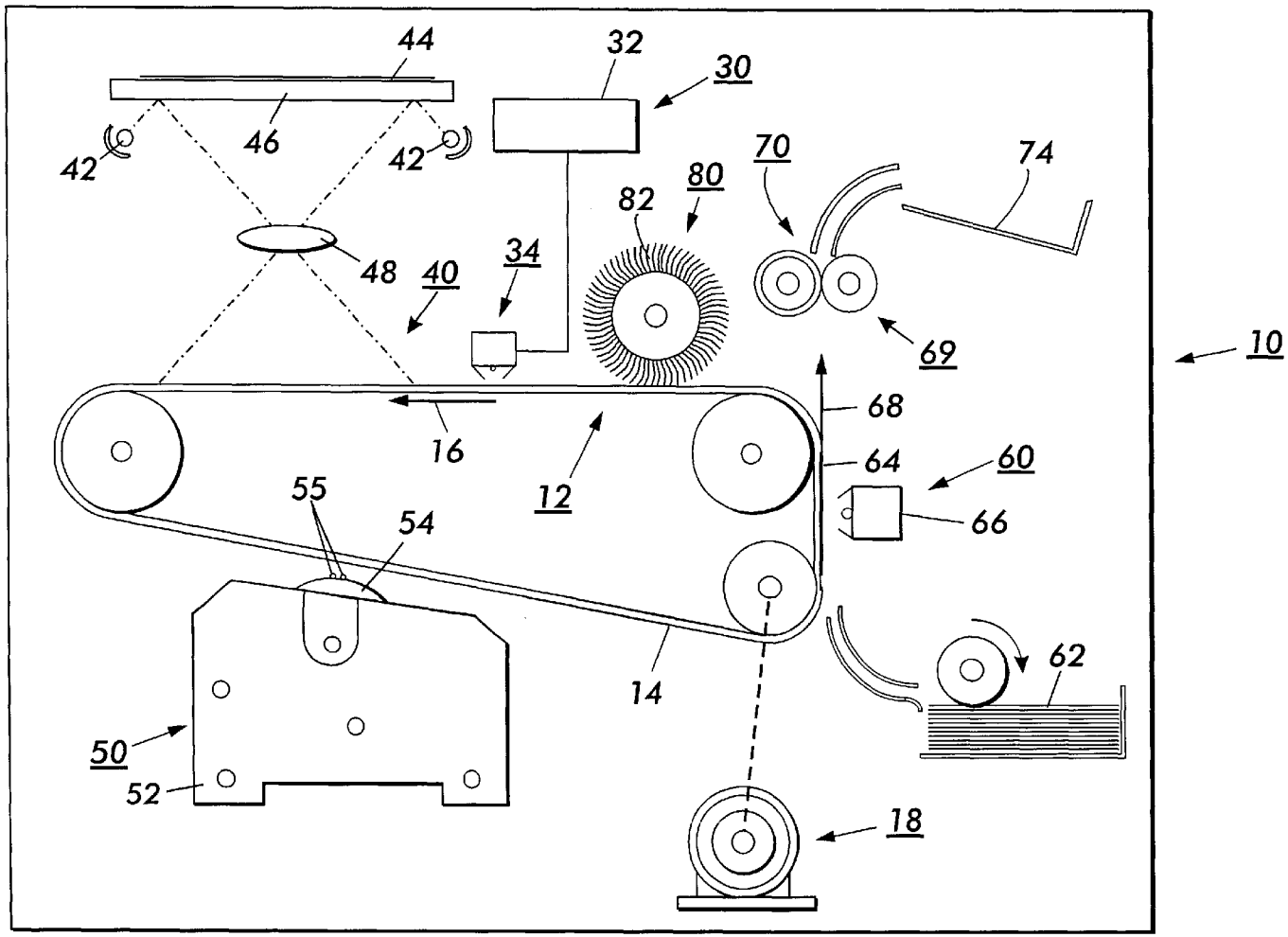
FIG. 1 illustrates a scavengeless electrostatographic development apparatus including an exemplary embodiment of a donor roll according to this invention.

FIG. 1 shows a scavengeless electrostatic imaging apparatus 10 including an exemplary embodiment of a donor roll 54 according to this invention. The imaging apparatus 10 includes an image bearing member in the form of a belt 12 having an outer photoconductive surface 14. The image bearing member can alternatively comprise other types of photoconductive image bearing members, such as a drum having a photoconductive surface. The belt 12 moves in the direction of the arrow 16 to advance successive portions of the photoconductive surface 14 sequentially through various processing stations during the imaging process. The belt 12 is driven by a motor 18.

Initially, a portion of the belt 12 passes through a charging station 30 where a power supply 32 causes a corona generating device 34 to charge a portion of the photoconductive surface 14 of the belt 12.

The charged portion of the belt 12 is advanced to a exposure station 40. At the exposure station 40, one or more light sources such as lamps 42 emit light that is reflected onto an original document 44 seated on a transparent platen 46. The light reflected imagewise from the original image of the document 44 is transmitted through a lens 48. The lens 48 focuses the imagewise light onto the charged portion of the photoconductive surface 14 to selectively dissipate the charge to form a latent image. The latent image formed on the photoconductive surface 14 corresponds to the informational areas contained within the original image of the document 44. For such imagewise exposure of the photoconductive surface 14 in a digital copier, a laser printer and the like, a raster output scanner (ROS) can alternatively be used instead of the lamps 42 and lens 48.

After the electrostatic latent image is formed on the photoconductive surface 14, the belt 12 advances the latent image to a development station 50. At the development station 50, a development apparatus 52 develops the latent image recorded on the photoconductive surface 14 to form a toner image.

The belt 12 then advances the toner image to a transfer station 60 where a copy sheet 62 is advanced by a sheet feeding apparatus 64 to transfer the toner image to the sheet 62. The transfer station 60 also includes a corona generating device 66, which sprays ions onto the sheet 62 to attract the toner image from the photoconductive surface 14 onto the sheet 62. After this image transfer, the sheet 62 is separated from the belt 12 and moved in the direction of the arrow 68 by rollers 69 to a fusing station 70.

The fusing station 70 includes a fuser assembly that heats, fuses and permanently affixes the toner image to the sheet 62, forming a sheet copy of the original image of document 44. The sheet 62 is then advanced to a tray 74.

The belt 12 moves the portion of the surface 14 from which the image had been transferred to the sheet 62 to a cleaning station 80. The cleaning station 80 can include a brush 82 or the like that rotates in contact with the photoconductive surface 14 to remove the residual toner particles. Next, light is emitted onto the photoconductive surface 14 to dissipate any residual electrostatic charge on the belt 12.

Figure 2:
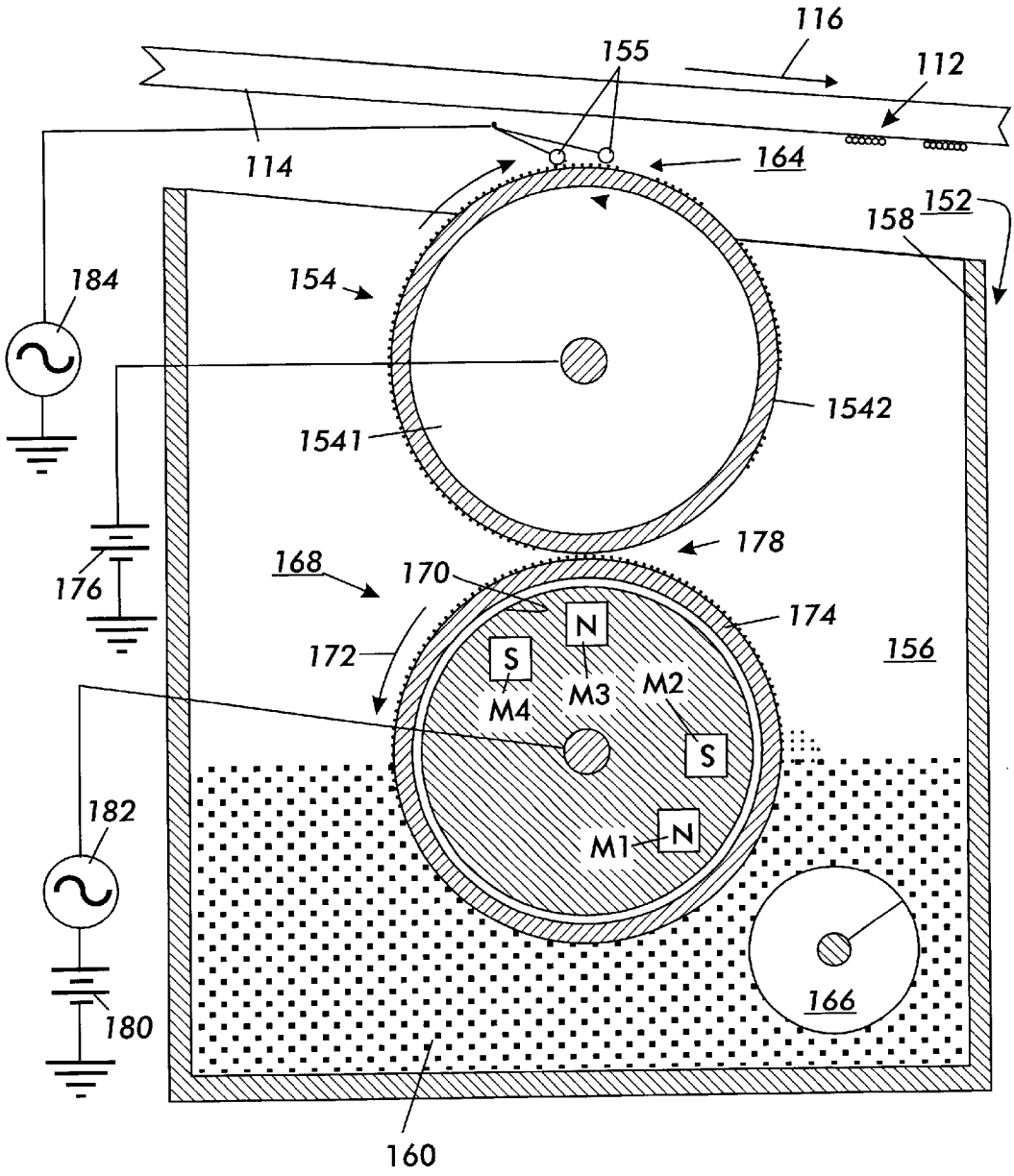
FIG. 2 illustrates a hybrid scavengeless development device including an exemplary embodiment of a donor roll according to this invention.

FIG. 2 shows a hybrid scavengeless two-component development apparatus 152 including an exemplary embodiment of a donor roll 154. Donor roll can be fabricated as disclosed in U.S. Pat. No. 6,327,453 which is hereby incorporated by reference. The donor roll 154 is mounted partially within a mixing chamber 156 defined by a housing 158. The mixing chamber 156 holds a supply of a two-component developer material 160 comprising toner particles and carrier beads. The donor roll 154 transports toner particles that have been fed from the mixing chamber 156 into contact with electrode wires 155 within a development zone 164 for latent image development. The developer material 160 is moved and mixed within the mixing chamber 156 by a mixing device 166 to charge the carrier beads and toner particles. The oppositely charged toner particles adhere triboelectrically to the charged magnetizable carrier beads.

The development apparatus 152 also includes a developer material feeder assembly, such as a magnetic roll 168, that feeds a quantity of the developer material 160 from the mixing chamber 156 to the donor roll 154. The magnetic roll 168 includes a substrate 170. The substrate 170 rotates in the direction of the arrow 172, and includes a coating 174, and magnetic members M1 to M4. The magnetic roll 168 and the donor roll 154 are electrically biased relative to each other so that charged toner particles of the developer material 160 fed to the donor roll 154 are attracted from the magnetic roll 168 to the donor roll 154. In some other embodiments, the coating 174 is not needed on the substrate 170 to provide the desired transport properties. In addition, the substrate 170 can include a different number of magnetic members than the four magnetic members Ml to M4 in FIG. 2.

As also shown in FIG. 2, the donor roll 154 is biased to a specific voltage by a direct current (DC) power supply 176 so that the donor roll 154 attracts charged toner particles from the magnetic roll 168 in a nip 178. To enhance the attraction of charged toner particles from the mixing chamber 156, the magnetic roll 168 is also biased by a DC voltage source 180. The magnetic roll 168 is also biased by an AC voltage source 182 that temporarily loosens the charged toner particles from the magnetized carrier beads. The loosened charged toner particles are attracted to the donor roll 154. An AC bias is also applied to the electrode wires 155 by an AC voltage source 184 to loosen charged toner particles from the donor roll 154, and to form a toner cloud within the development zone 164.

Other embodiments of the hybrid scavengeless two-component development apparatus 152 can comprise more than one donor roll 154, such as, for example, two donor rolls 154. Such apparatus can also include more than one magnetic roll 168 and more than one mixing device 166.

The donor roll 154 can also be used in scavengeless single-component development apparatus.

Figure 3:
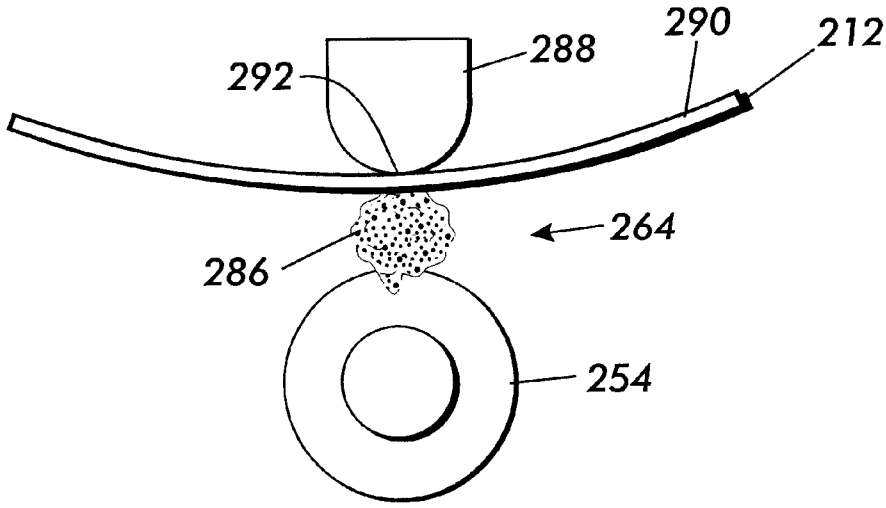
FIG. 3 is an end view showing a portion of the development zone region in a hybrid scavengeless development device.
Figure 4:
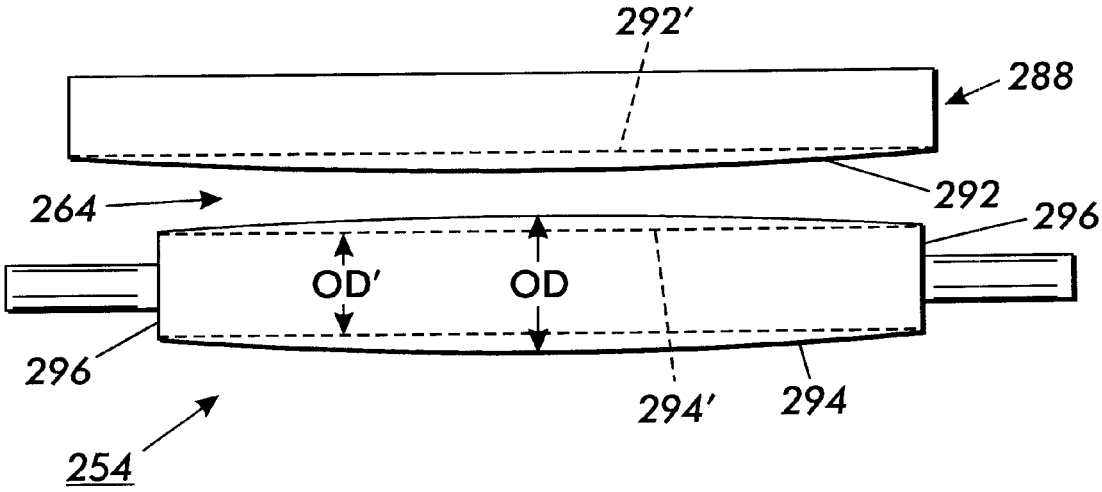
FIGS. 4–6 are side views of the backerbar and donor roll of FIG. 3.
Figure 5:
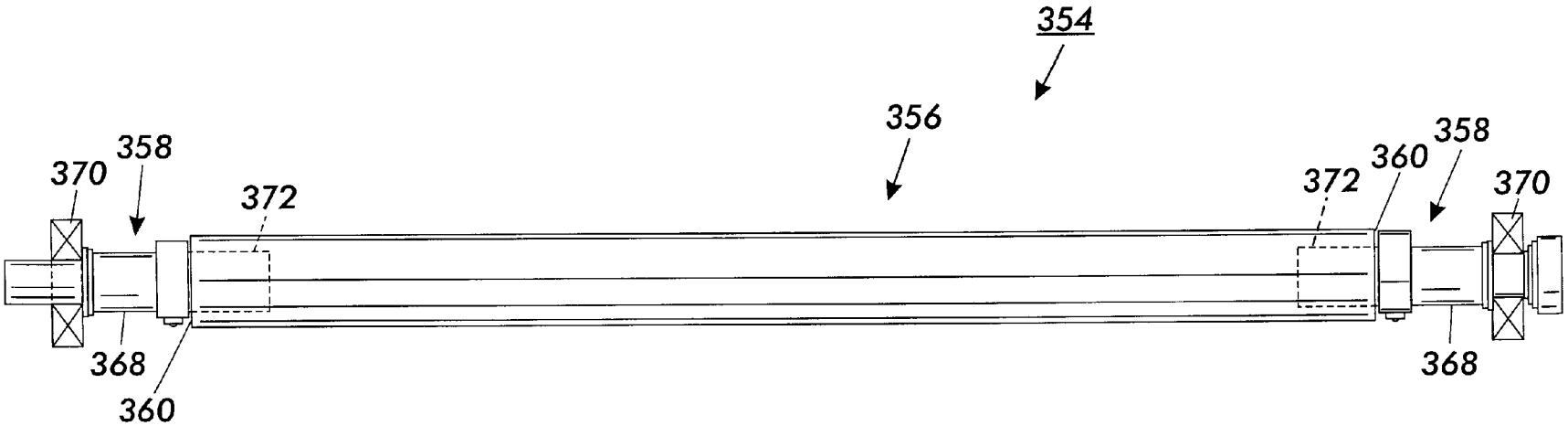

FIG. 3 shows a portion of the development zone 264, including the belt 212, the donor roll 254 and a toner cloud 286 formed between the belt 212 and donor roll 254. A backerbar 288 contacts the inner surface 290 of the belt 212. During imaging, toner from the toner cloud 286 deposits on the latent image formed on the belt 212.

As described above, the tolerances of the donor roll 254, the belt 212 and the backerbar 288 contribute to the macrouniformity of the development device.

Figure 6:
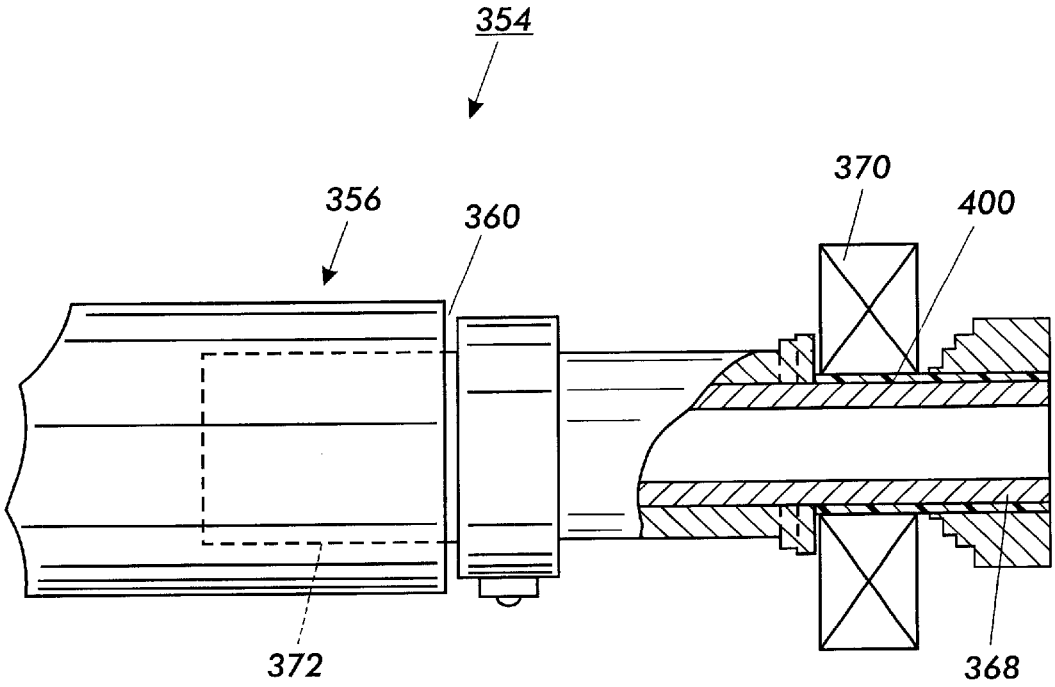

According to the present invention as shown in FIG. 6, development device which is in the form of a donor roll is provided with coatings 400 or bands of electrical insulating material interposed between the donor roll and its associated bearing structure 370 for the purpose of impeding the transfer of electrical interference from the backer bar structure to donor roll structure. The bands or coatings are preferably applied to the donor roll structure, for example, by plasma spraying a ceramic material on journals thereof. The ceramic coatings or bands are plasma sprayed onto the relevant parts or areas of the journals in the desired thickness and the sprayed ceramic material has the desired electrical properties. The preferred coating is alumina. Although plasma spraying is the preferred process to spray the coating, other thermal spray processes such as HVOF may also be used. If necessary, the material forming the coatings or bands may be ground to the desired thickness using techniques well known in the art. Journals are fabricated from stainless steel having coating 400 thereon.

Machining of the bearing surfaces of the coatings or bands can be controlled to a tight tolerance and the ceramic coating is very hard thereby eliminating any potential for galling in the areas of contact. The journals are fitted into bearing 370 which support the donor roll and provides a development gap/space between the backerbar with the photoreceptor being interposed between the donor roll and the backerbar.

The preferred coating thickness depends on the coating material selected and, specifically, its dielectric breakdown strength. In a specific embodiment, alumina is plasma sprayed to form the coating. The preferred coating thickness is 375–400 microns.

While the invention has been described in conjunction with the specific embodiments described above, it is evident that many alternatives, modifications and variations are apparent to those skilled in the art. Accordingly, the preferred embodiments of the invention as set forth above are intended to be illustrative and not limiting. Various changes can be made without departing from the spirit and scope of the invention.

What is claimed is:

1. A donor structure for developing toner images to an image receiving surface, said structure comprising:

a core structure; end caps including journal portions attached to said core structure;

a bearing for operatively supporting said donor structure in an imaging device; and electrically isolating coatings carried by said journal portions, said electrically isolating coatings being interposed between said journal portions and said bearings; and a backerbar, said backerbar is being spaced from said donor structure and is in contact with an outer surface of said bearing.

2. Apparatus according to claim 1 wherein said coatings comprise electrically insulative ceramic material.

3. Apparatus according to claim 2 wherein said coatings are plasma sprayed onto said journals.

4. Apparatus according to claim 3 wherein the thickness of said coatings is in the order of 375 to 400 microns.

5. The developer apparatus having a donor structure for developing toner images to an image receiving surface, said structure comprising:

a core structure; end cars including journal portions attached to said core structure;

a bearing for operatively supporting said donor structure in an imaging device; and electrically isolating coatings carried by said journal portions, said electrically isolating coatings being interposed between said journal portions and said bearings; and a backerbar, said backerbar is being spaced from said donor structure and is in contact with an outer surface of said bearing.

6. The developer apparatus according to claim 5 wherein said coatings comprise electrically insulative ceramic material.

7. The developer apparatus according to claim 6 wherein said coatings are plasma sprayed onto said journals.

8. The developer apparatus according to claim 7 wherein the thickness of said coatings is in the order of 375 to 400 microns.

9. A printing machine including an apparatus for developing toner images to an image receiving surface, said structure comprising:

a core structure; end caps including journal portions attached to said core structure;

a bearing for operatively supporting said donor structure in an imaging device; and electrically isolating coatings carried by said journal portions, said electrically isolating coatings being interposed between said journal portions and said bearings; and a backerbar, said backerbar is being spaced from said donor structure and is in contact with an outer surface of said bearing.

10. A printing machine having an apparatus according to claim 9 wherein said coatings comprise electrically insulative ceramic material.

11. A printing machine having an apparatus according to claim 10 wherein said coatings are plasma sprayed onto said journals.

12. A printing machine having an apparatus according to claim 11 wherein the thickness of said coatings is in the order of 375 to 400 microns.

* * * * *